US009129787B2

(12) United States Patent
Bateman et al.

(10) Patent No.: US 9,129,787 B2
(45) Date of Patent: Sep. 8, 2015

(54) MASS SPECTROMETER

(75) Inventors: Robert Harold Bateman, Cheshire (GB); Jeffery Brown, Cheshire (GB); Martin Green, Cheshire (GB)

(73) Assignee: Micromass UK Limited, Wilmslow (GB)

( * ) Notice: Subject to any disclaimer, the term of this patent is extended or adjusted under 35 U.S.C. 154(b) by 1895 days.

(21) Appl. No.: 11/571,917

(22) PCT Filed: Jul. 21, 2005

(86) PCT No.: PCT/GB2005/002874

§ 371 (c)(1), (2), (4) Date: Jan. 10, 2008

(87) PCT Pub. No.: WO2006/008537

PCT Pub. Date: Jan. 26, 2006

(65) Prior Publication Data

US 2008/0191130 A1 Aug. 14, 2008

Related U.S. Application Data

(60) Provisional application No. 60/598,787, filed on Aug. 4, 2004.

(30) Foreign Application Priority Data

Jul. 21, 2004 (GB) ..... 0416288.9

(51) Int. Cl.
*H01J 49/40* (2006.01)
*H01J 49/06* (2006.01)
(Continued)

(52) U.S. Cl.
CPC ..... *H01J 49/062* (2013.01); *H01J 49/027* (2013.01); *H01J 49/422* (2013.01); *H01J 49/4245* (2013.01)

(58) Field of Classification Search
USPC ..... 250/281, 282, 283, 290, 291, 292, 293, 250/294, 295, 296, 297, 298, 299
See application file for complete search history.

(56) References Cited

U.S. PATENT DOCUMENTS 4,686,365 A 8/1987 Meek et al.
4,755,670 A 7/1988 Syka et al.
(Continued)

FOREIGN PATENT DOCUMENTS

EP 0736894 10/1996
EP 1267386 12/2002
(Continued)

OTHER PUBLICATIONS

Li et al., "A Segmented Ring, Cylindrical Ion Trap Source for Time-of-Flight Mass Spectrometry", American Society for Mass Spectrometry 1996, pp. 1009-1017.*
(Continued)

*Primary Examiner* — Nicole Ippolito
(74) *Attorney, Agent, or Firm* — Diederiks & Whitelaw, PLC

(57) ABSTRACT

A mass spectrometer is disclosed comprising a segmented linear ion guide or ion trap. Ions are confined radially within the ion guide or ion trap by the application of an AC or RF voltage to the electrodes forming the ion guide or ion trap. A quadratic DC potential is applied along the axial length of the ion guide or ion trap in order to cause trapped ions to perform simple harmonic motion within the ion guide or ion trap. The frequency of the oscillations of the ions is detected using one or more inductive detectors. The mass to charge ratio of the ions can then be determined from the determined frequency of oscillations.

36 Claims, 8 Drawing Sheets

(51) Int. Cl.
*H01J 49/02* (2006.01)
*H01J 49/42* (2006.01)

(56) References Cited

U.S. PATENT DOCUMENTS

| | | | | |
|---|---|---|---|---|
| 4,990,856 | A | 2/1991 | Anderson et al. | |
| 5,783,824 | A | 7/1998 | Baba et al. | |
| 6,403,955 | B1 | 6/2002 | Senko | |
| 6,452,168 | B1 | 9/2002 | McLuckey et al. | |
| 6,759,651 | B1 | 7/2004 | Li | |
| 7,425,699 | B2 | 9/2008 | Makarov et al. | |
| 2002/0003210 | A1 * | 1/2002 | Marcus | 250/288 |
| 2002/0190200 | A1 * | 12/2002 | Zajfman et al. | 250/287 |
| 2002/0190205 | A1 * | 12/2002 | Park | 250/292 |
| 2004/0195503 | A1 * | 10/2004 | Kim et al. | 250/288 |
| 2004/0245454 | A1 | 12/2004 | West et al. | |
| 2004/0245455 | A1 * | 12/2004 | Reinhold | 250/288 |
| 2005/0253064 | A1 * | 11/2005 | Loboda et al. | 250/292 |

FOREIGN PATENT DOCUMENTS

| | | |
|---|---|---|
| EP | 1367633 | 12/2006 |
| GB | 2364168 | 1/2002 |
| WO | 99/62101 | 12/1999 |
| WO | WO 01/15201 | 3/2001 |

OTHER PUBLICATIONS

Knight, R. D: "Storage of Ions From Laser-Produced Plasmas", Applied Physics Letters, AIP, American Institute of Physics, Melville, NY, US, vol. 38, No. 4, Feb. 15, 1981, pp. 221-223.

Giannakopulos et al. "*Tandem time-of-flight mass spectrometer* (*TOF-TOF*) *with quadratic-field ion mirror*" Review of Scientific Instruments, pp. 2115-2123, vol. 73, No. 5, 2002.

* cited by examiner

MASS SPECTROMETER

CROSS REFERENCE TO RELATED APPLICATIONS

This application is the National Stage of International Application No. PCT/GB2005/002874, filed on Jul. 21, 2005, which claims priority to and benefit of U.S. Provisional Patent Application Ser. No. 60/598,787, filed on Aug. 4, 2004, and priority to and benefit of United Kingdom Patent Application No. 0416288.9, filed on Jul. 21, 2004. The entire contents of these applications are incorporated herein by reference.

The present invention relates to a mass spectrometer and a method of mass spectrometry.

Various ion trapping techniques are well known in the field of mass spectrometry. Commercially available 3D or Paul ion traps, for example, provide a powerful and relatively inexpensive tool for many types of organic analysis. 3D or Paul ion traps comprise a central cylindrical ring electrode and two end cap electrodes having hyperbolic surfaces facing the ring electrode. An RF voltage is applied between the two end cap electrodes and the ring electrode so that a three dimensional quadrupole electric field is established which oscillates at RF frequencies in order to confine ions within the ion trap. A number of different approaches may be adopted in order to eject ions out from the ion trap. For example, mass selective instability may be used wherein the amplitude or frequency of the applied RF voltage is varied. Another approach is resonance ejection wherein a small supplementary voltage is applied to the electrodes. A further approach is to apply a DC bias voltage between the ring electrode and the end cap electrodes in order to eject ions from the ion trap.

3D or Paul ion traps suffer from the disadvantage that they have a relatively limited mass resolution. Furthermore, 3D or Paul ion traps have a relatively limited mass accuracy and limited dynamic range due to low space charge capacity.

Fourier Transform Ion Cyclotron Resonance (FT-ICR) mass spectrometers are known which are capable of producing high resolution exact mass spectral data. Ion trapping in these mass spectrometers is accomplished by using a very strong magnetic field produced by a large superconducting magnet in combination with an electric field. Trapped ions are caused to spiral around the magnetic field lines with a frequency related to the mass to charge ratio of the ion. The ions are then excited such that the radii of their spiraling motion increases. As the radii increase, the ions are arranged to pass close to a detector plate in which they induce image currents.

Fourier Transform Ion Cyclotron Resonance mass spectrometers are relatively large and expensive due to the requirement of using a large superconducting magnet cooled by liquid helium. A further disadvantage of Fourier Transform Ion Cyclotron Resonance mass spectrometers is that they require ultra high vacuums and suffer from a limited dynamic range.

A further conventional form of mass spectrometer is known which is referred to as an Orbitrap. Orbitrap mass spectrometers differ, for example, from 3D or Paul ion traps in that they use solely electrostatic (DC) ion trapping fields for confining ions in both the axial and radial directions. Ions are caused to orbit around a central electrode and perform harmonic oscillations in the axial direction. Reference is made, for example, to Anal. Chem. 2000, 72, 1156-1162 and U.S. Pat. No. 5,886,346 (Makarov) for details concerning Orbitrap mass spectrometers.

Orbitraps are capable of producing high quality mass spectral data with a high dynamic range and these ion traps are relatively inexpensive. However, Orbitraps nonetheless suffer from a number of serious disadvantages.

Firstly, Orbitraps require an Ultra High Vacuum ("UHV") of $10^{-8}$ mbar or lower for operation. Collisions with residual gas molecules will lower the kinetic energy of the ions orbiting the central electrode. This will reduce the radius of the orbit of the ions and will result in losses of ions to the central electrode.

Secondly, it is not possible to collisionally cool ions within an Orbitrap prior to analysis as this would result in losses to the central electrode. The axial and radial ion energy spread is dictated by the injection optics external to the ion trap.

Thirdly, there is a relatively narrow range of acceptance energies and initial entrance angles into an Orbitrap which will result in stable orbits around the central electrode. Accordingly, there is a reduction in the efficiency of initial trapping of ions generated by an external ion source.

Fourthly, resonance excitation and mass selective instability, facilitated by application of a RF voltage to the central electrode can lead to undesired resonance of some ions in the radial direction. This can lead to ion losses to the inner or outer electrode in this mode of operation.

For completeness a yet further form of mass spectrometer is known wherein ions oscillate between two electrostatic mirrors arranged to oppose each other and which are separated by a field free region. Reference is made to the arrangement disclosed in "Ion motion Synchronisation in an Ion Trap Resonator", M. L. Rappaport, Physical Review Letters, Vol. 87, No. 5. The frequency of the oscillation is measured using image current detection. The frequency of oscillation is not, however, independent of the ion energy or spatial spread and accordingly this device suffers from a poor mass resolution. Furthermore, the electrostatic ion trap resonator disclosed by Rappaport et al. does not radially confine ions. This leads to several disadvantages.

Firstly, ion bunches will spread in the radial direction as the oscillations in the axial direction proceed. This spread is dependent on the initial radial energy spread of the ions and the radial field produced by the voltage applied to the ion mirrors. Ions are eventually lost radially.

Secondly, the device needs to be operated at very high vacuum. Collisions with residual gas molecules will lead to a reduction of the axial energy and a decrease in the amplitude of the oscillations. Additionally, collisions will cause scattering of the ions leading to losses in the radial direction.

Thirdly, in this device the frequency of the ion oscillations is dependent upon the ion energy. Hence, the spread in frequencies is dependent upon the ion energy and spatial spread. As a consequence this device does not exhibit high resolution.

It is therefore desired to provide an improved ion guide or ion trap.

According to an aspect of the present invention there is provided a mass spectrometer comprising:

an ion guide or ion trap comprising a plurality of electrodes, the ion guide or ion trap having a longitudinal axis;

AC or RF voltage means for applying an AC or RF voltage to at least some of the electrodes in order to confine at least some ions radially within the ion guide or ion trap;

oscillation means arranged and adapted to cause at least some ions to oscillate in an axial direction in a mode of operation; and detector means for determining the frequency of oscillations of the ions in the axial direction.

The ion guide or ion trap preferably comprises a multipole rod set ion guide or ion trap. For example, the ion guide or ion trap preferably comprises a quadrupole, hexapole, octapole or higher order multipole rod set.

The ion guide or ion trap preferably comprises a plurality of electrodes having an approximately or substantially circular cross-section. According to an alternative embodiment the ion guide or ion trap comprises a plurality of electrodes wherein the electrodes have an approximately or substantially hyperbolic surface. According to a further embodiment, the ion guide or ion trap may comprise a plurality of electrodes which are approximately or substantially concave and have an arcuate or part-circular cross-section.

The radius inscribed by the multipole rod set ion guide or ion trap according to the preferred embodiment is preferably selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm.

According to an embodiment the ion guide or ion trap is preferably segmented axially or comprises a plurality of axial segments. For example, the ion guide or ion trap preferably comprises x axial segments, wherein x is selected from the group consisting of: (i) <10; (ii) 10-20; (iii) 20-30; (iv) 30-40; (v) 40-50; (vi) 50-60; (vii) 60-70; (viii) 70-80; (ix) 80-90; (x) 90-100; and (xi) >100. Preferably, each axial segment comprises 1, 2, 3, 4, 5, 6, 7, 8, 9, 10, 11, 12, 13, 14, 15, 16, 17, 18, 19, 20 or >20 electrodes.

The axial length of at least 10%, 20%, 30%, 40%, 50%, 60%, 70%, 80%, 90%, 95% or 100% of the axial segments is preferably selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm. According to an embodiment the spacing between at least 10%, 20%, 30%, 40%, 50%, 60%, 70%, 80%, 90%, 95% or 100% of the axial segments is selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm. According to an alternative embodiment the ion guide or ion trap may comprise a plurality of non-conducting, insulating or ceramic rods, projections or devices. For example, the ion guide or ion trap comprises 1, 2, 3, 4, 5, 6, 7, 8, 9, 10, 11, 12, 13, 14, 15, 16, 17, 18, 19, 20 or >20 rods, projections or devices. The plurality of non-conducting, insulating or ceramic rods, projections or devices may further comprise one or more resistive or conducting coatings, layers, electrodes, films or surfaces. The one or more resistive or conducting coatings, layers, electrodes, films or surfaces are preferably provided on, around, over or in proximity to one or more of the non-conducting, insulating or ceramic rods, projections or devices.

According to a further alternative embodiment the ion guide or ion trap may comprise a plurality of electrodes having apertures wherein ions are transmitted, in use, through the apertures. Preferably, at least 10%, 20%, 30%, 40%, 50%, 60%, 70%, 80%, 90%, 95% or 100% of the electrodes have apertures which are substantially the same size or which have substantially the same area. According to an alternative embodiment at least 10%, 20%, 30%, 40%, 50%, 60%, 70%, 80%, 90%, 95% or 100% of the electrodes have apertures which become progressively larger or smaller in size or in area in a direction along the axis of the ion guide or ion trap.

At least 10%, 20%, 30%, 40%, 50%, 60%, 70%, 80%, 90%, 95% or 100% of the electrodes preferably have apertures having internal diameters or dimensions selected from the group consisting of: (i)≤1.0 mm; (ii)≤2.0 mm; (iii)≤3.0 mm; (iv)≤4.0 mm; (v)≤5.0 mm; (vi)≤6.0 mm; (vii)≤7.0 mm; (viii)≤8.0 mm; (ix)≤9.0 mm; (x)≤10.0 mm; and (xi) >10.0 mm.

According to an embodiment the ion guide or ion trap comprises 1, 2, 3, 4, 5, 6, 7, 8, 9, 10 or >10 electrodes. According to an embodiment the ion guide or ion trap comprises: (i) 10-20 electrodes; (ii) 20-30 electrodes; (iii) 30-40 electrodes; (iv) 40-50 electrodes; (v) 50-60 electrodes; (vi) 60-70 electrodes; (vii) 70-80 electrodes; (viii) 80-90 electrodes; (ix) 90-100 electrodes; (x) 100-110 electrodes; (xi) 110-120 electrodes; (xii) 120-130 electrodes; (xiii) 130-140 electrodes; (xiv) 140-150 electrodes; or (xv) >150 electrodes.

The ion guide or ion trap preferably has a length selected from the group consisting of: (i) <20 mm; (ii) 20-40 mm; (iii) 40-60 mm; (iv) 60-80 mm; (v) 80-100 mm; (vi) 100-120 mm; (vii) 120-140 mm; (viii) 140-160 mm; (ix) 160-180 mm; (x) 180-200 mm; and (xi) >200 mm.

According to an embodiment the AC or RF voltage means is preferably arranged and adapted to apply an AC or RF electric field to at least 10%, 20%, 30%, 40%, 50%, 60%, 70%, 80%, 90%, 95% or 100% of the electrodes forming the ion guide or ion trap in order to confine ions radially within the ion guide or ion trap.

The AC or RF voltage means is preferably arranged and adapted to supply an AC or RF voltage having an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

According to an embodiment the AC or RF voltage means is arranged and adapted to supply an AC or RF voltage having a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The oscillation means is preferably arranged and adapted to cause ions to undergo simple harmonic motion in the axial direction. According to an embodiment the oscillation means comprises one or more DC or static voltage or potential supplies for supplying one or more DC or static voltages or potentials to the electrodes. The oscillation means is preferably arranged and adapted to maintain an approximately quadratic or substantially quadratic DC potential along at least 10%, 20%, 30%, 40%, 50%, 60%, 70%, 80%, 90%, 95% or 100% of the axial length of the ion guide or ion trap.

According to an embodiment the quadratic DC potential comprises a potential well having a depth selected from the group consisting of: (i) <10 V; (ii) 10-20 V; (iii) 20-30 V; (iv) 30-40 V; (v) 40-50 V; (vi) 50-60 V; (vii) 60-70 V; (viii) 70-80 V; (ix) 80-90 V; (x) 90-100 V; and (xi) >100 V.

The oscillation means is preferably arranged and adapted to maintain the approximately quadratic or substantially quadratic DC potential having a minimum located at a first position along the axial length of the ion guide or ion trap, and wherein ions are caused to undergo simple harmonic motion about the first position.

Prior to the oscillation means maintaining the approximately quadratic or substantially quadratic DC potential along the axial length of the ion guide or ion trap, ions are preferably located, trapped or positioned at a position away from the first position such that upon application of the approximately quadratic or substantially quadratic DC potential ions are preferably accelerated towards the first position.

According to an embodiment the ion guide or ion trap has a first axial end and a second axial end, and wherein the first position is located at a distance L downstream of the first axial end or upstream of the second axial end, and wherein L is selected from the group consisting of: (i) <20 mm; (ii) 20-40 mm; (iii) 40-60 mm; (iv) 60-80 mm; (v) 80-100 mm; (vi) 100-120 mm; (vii) 120-140 mm; (viii) 140-160 mm; (ix) 160-180 mm; (x) 180-200 mm; and (xi) >200 mm.

The mass spectrometer preferably further comprises means arranged and adapted to maintain a substantially linear electrostatic field along at least 10%, 20%, 30%, 40%, 50%, 60%, 70%, 80%, 90%, 95% or 100% of the axial length of the ion guide or ion trap.

The mass spectrometer is preferably arranged and adapted to re-energize or accelerate ions which have previously been caused to oscillate by the oscillation means but which have subsequently lost energy and are located towards the minimum of an axial potential well.

According to an embodiment the mass spectrometer further comprises means arranged and adapted to maintain at least 1, 2, 3, 4, 5, 6, 7, 8, 9 or 10 discrete potential wells along the axial length of the ion guide or ion trap.

The detector means preferably comprises one or more inductive or capacitive detectors. The one or more inductive or capacitive detectors are preferably arranged substantially along substantially zero potential planes within the ion guide or ion trap and/or at the ion entrance to the ion guide or ion trap and/or at the ion exit to the ion guide or ion trap. The one or more inductive or capacitive detectors may comprise a plurality of discrete or individual detectors or detecting regions arranged in the axial direction.

According to the preferred embodiment the ion guide or ion trap is segmented in the axial direction and at least 10%, 20%, 30%, 40%, 50%, 60%, 70%, 80%, 90%, 95% or 100% of the plurality of discrete or individual detectors or detecting regions are preferably maintained at a DC potential or voltage substantially similar to a DC potential or voltage at which an adjacent segment of the ion guide or ion trap is maintained.

According to an embodiment the detector means is preferably arranged and adapted to measure the frequency of oscillations of the ions directly or indirectly.

According to a less preferred embodiment the detector means may comprise an optical detector. The optical detector may be arranged and adapted to detect fluorescence from ions after the ions have been irradiated.

The detector means preferably further comprises Fourier transform means for transforming time domain data or data relating to ion oscillations into frequency domain data or data relating to the frequency of ion oscillations. The detector means preferably further comprises means for determining the mass or mass to charge ratio of ions from the frequency domain data.

According to an embodiment in a mode of operation, preferably a mode of operation wherein ions are caused to oscillate within the ion guide of ion trap, the ion guide or ion trap is preferably maintained, in use, at a pressure selected from the group consisting of: (i) $<1.0\times10^{-1}$ mbar; (ii) $<1.0\times10^{-2}$ mbar; (iii) $<1.0\times10^{-3}$ mbar; (iv) $<1.0\times10^{-4}$ mbar; (v) $<1.0\times10^{-5}$ mbar; (vi) $<1.0\times10^{-6}$ mbar; (vii) $<1.0\times10^{-7}$ mbar; (viii) $<1.0\times10^{-8}$ mbar; (ix) $<1.0\times10^{-9}$ mbar; (x) $<1.0\times10^{-10}$ mbar; (xi) $<1.0\times10^{-11}$ mbar; and (xii) $<1.0\times10^{-12}$ mbar.

According to an embodiment the ion guide or ion trap preferably comprising means arranged and adapted to maintain in a mode of operation, preferably a mode of operation wherein ions are collisionally cooled and/or fragmented within the ion guide or ion trap, the ion guide or ion trap at a pressure selected from the group consisting of: (i) $>1.0\times10^{-3}$ mbar; (ii) $>1.0\times10^{-2}$ mbar; (iii) $>1.0\times10^{-1}$ mbar; (iv) >1 mbar; (v) >10 mbar; (vi) >100 mbar; (vii) $>5.0\times10^{-3}$ mbar; (viii) $>5.0\times10^{-2}$ mbar; (ix) $10^{-3}$-$10^{-2}$ mbar; and (x) $10^{-4}$-$10^{-1}$ mbar.

According to an embodiment in a mode of operation ions are trapped but are not substantially fragmented within the ion guide or ion trap. According to an embodiment in a mode of operation ions are collisionally cooled or substantially thermalised within the ion guide or ion trap. According to an embodiment ions are collisionally cooled or substantially thermalised within the ion guide or ion trap prior and/or subsequent to ions being caused to oscillate in the axial direction. According to an embodiment means are provided to substantially fragment ions within the ion guide or ion trap.

One or more further ion guides or ion traps may be arranged upstream and/or downstream of the ion guide or ion trap. According to an embodiment ions are collisionally cooled or substantially thermalised within the one or more further ion guides or ion traps. This may be prior to and/or subsequent to ions being caused to oscillate in the axial direction.

According to an embodiment ions from the one or more further ion guides or ion traps are introduced, axially injected or ejected, radially injected or ejected, transmitted or pulsed from the one or more further ion guides or ion traps into the ion guide or ion trap.

In a mode of operation ions are trapped and are preferably substantially fragmented within the one or more further ion guides or ion traps.

The mass spectrometer preferably further comprises ejection means arranged and adapted to resonantly and/or mass selectively eject ions from the ion guide or ion trap. The ejection means may be arranged and adapted to eject ions axially and/or radially from the ion guide or ion trap. For example, the ejection means may comprise means arranged and adapted to adjust the frequency and/or amplitude of the AC or RF voltage in order to eject ions by mass selective instability. Alternatively, the ejection means may comprise means for superimposing an AC or RF supplementary waveform or voltage to the plurality of electrodes in order to eject ions by resonance ejection. According to a yet further embodiment, the ejection means may comprise means for applying a DC bias voltage in order to eject ions.

An advantageous feature of the present invention is that the preferred ion guide or ion trap may be operated in other modes of operation. For example, in a further mode of operation the ion guide or ion trap may be arranged to transmit or store ions without ions being caused to substantially oscillate in the axial direction. In a further mode of operation the ion guide or ion trap may be arranged to act as a mass filter or mass analyser. Alternatively, in a further mode of operation the ion guide or ion trap may be arranged to act as a collision or fragmentation cell without ions being caused to oscillate in the axial direction.

According to a preferred embodiment the mass spectrometer further comprises means arranged and adapted to store or trap ions within the ion guide or ion trap at one or more positions which are preferably closest to the entrance and/or centre and/or exit of the ion guide or ion trap. The mass spectrometer may further comprise means arranged and adapted to trap ions within the ion guide or ion trap and to progressively move ions towards the entrance and/or centre and/or exit of the ion guide or ion trap.

In use one or more transient DC voltages or one or more transient DC voltage waveforms may be initially provided at a first axial position and are then preferably subsequently provided at second, then third different axial positions along the ion guide or ion trap.

One or more transient DC voltages or one or more transient DC voltage waveforms may be arranged to move in use from one end of the ion guide or ion trap to another end of the ion guide or ion trap so that ions are urged along the ion guide or ion trap. The one or more transient DC voltages may create: (i) a potential hill or barrier; (ii) a potential well; (iii) multiple potential hills or barriers; (iv) multiple potential wells; (v) a combination of a potential hill or barrier and a potential well; or (vi) a combination of multiple potential hills or barriers and multiple potential wells.

The one or more transient DC voltage waveforms may comprise a repeating waveform or square wave.

According to an embodiment the mass spectrometer further comprises means arranged to apply a trapping electrostatic potential at a first end and/or a second end of the ion guide or ion trap. The mass spectrometer may comprise means arranged to apply one or more trapping electrostatic potentials along the axial length of the ion guide or ion trap.

The mass spectrometer may comprise one or more ion detectors arranged upstream and/or downstream of the ion guide or ion trap. The one or more ion detectors may comprise Microchannel Plate detectors.

According to an embodiment the mass spectrometer further comprises an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; and (xvi) a Nickel-63 radioactive ion source.

The ion source may comprises a continuous or pulsed ion source.

The mass spectrometer preferably further comprises means for introducing, axially injecting or ejecting, radially injecting or ejecting, transmitting or pulsing ions into the ion guide or ion trap.

The mass spectrometer preferably further comprises a mass analyser. The mass analyser is preferably selected from the group consisting of: (i) a Fourier Transform ("FT") mass analyser; (ii) a Fourier Transform Ion Cyclotron Resonance ("FTICR") mass analyser; (iii) a Time of Flight ("TOF") mass analyser; (iv) an orthogonal acceleration Time of Flight ("oaTOF") mass analyser; (v) an axial acceleration Time of Flight mass analyser; (vi) a magnetic sector mass spectrometer; (vii) a Paul or 3D quadrupole mass analyser; (viii) a 2D or linear quadrupole mass analyser; (ix) a Penning trap mass analyser; (x) an ion trap mass analyser; (xi) a Fourier Transform orbitrap; (xii) an electrostatic Ion Cyclotron Resonance mass spectrometer; and (xiii) an electrostatic Fourier Transform mass spectrometer.

According to an aspect of the present invention there is provided a method of mass spectrometry comprising:

providing an ion guide or ion trap comprising a plurality of electrodes, the ion guide or ion trap having a longitudinal axis;

applying an AC or RF voltage to at least some of the electrodes in order to confine at least some ions radially within the ion guide or ion trap;

causing at least some ions to oscillate in an axial direction in a mode of operation; and determining the frequency of oscillations of the ions in the axial direction.

According to an aspect of the present invention there is provided a mass spectrometer comprising:

a linear ion guide or ion trap, the ion guide or ion trap comprising a plurality of segments and wherein in a mode of operation a quadratic DC potential is maintained along the axial direction of the ion guide or ion trap;

a measuring device for measuring the frequency of oscillations of ions;

means for performing a Fourier transform of data measured by the measuring device; and means for determining the mass or mass to charge ratio of ions caused to oscillate within the ion guide or ion trap from frequency data.

According to an aspect of the present invention there is provided a method of mass spectrometry comprising:

providing an ion guide or ion trap, the ion guide or ion trap comprising a plurality of segments;

maintaining a quadratic DC potential along the axial direction of the ion guide or ion trap;

measuring the frequency of oscillations of ions;

performing a Fourier transform of measured data; and determining the mass or mass to charge ratio of ions caused to oscillate within the ion guide or ion trap from frequency data.

According to an aspect of the present invention there is provided a mass spectrometer comprising:

an ion guide or ion trap comprising a plurality of electrodes having apertures, wherein ions are arranged, in use, to be transmitted through the apertures; and means arranged and adapted to maintain a quadratic DC potential gradient along at least a portion of the axial length of the ion guide or ion trap in a mode of operation so as to cause ions to undergo simple harmonic motion.

According to an aspect of the present invention there is provided a method of mass spectrometry comprising:

providing an ion guide or ion trap comprising a plurality of electrodes having apertures, wherein ions are arranged, in use, to be transmitted through the apertures; and maintaining a quadratic DC potential gradient along at least a portion of the axial length of the ion guide or ion trap in a mode of operation so as to cause ions to undergo simple harmonic motion.

According to an aspect of the present invention there is provided a mass spectrometer comprising:

an ion guide or ion trap comprising a ceramic or non-conductive multipole rod set, the multipole rod set comprising one or more resistive or conductive coatings, layers or electrodes arranged on the surface of the rod set; and means arranged and adapted to maintain a quadratic DC potential gradient along at least a portion of the axial length of the ion guide or ion trap in a mode of operation so as to cause ions to undergo simple harmonic motion.

According to an aspect of the present invention there is provided a method of mass spectrometry comprising:

providing an ion guide or ion trap comprising a ceramic or non-conductive multipole rod set, the multipole rod set comprising one or more resistive or conductive coatings, layers or electrodes arranged on the surface of the rod set; and maintaining a quadratic DC potential gradient along at least a portion of the axial length of the ion guide or ion trap in a mode of operation so as to cause ions to undergo simple harmonic motion.

According to an aspect of the present invention there is provided a mass spectrometer comprising:

an ion guide or ion trap comprising a plurality of electrodes, the ion guide or ion trap having a longitudinal axis;

means arranged and adapted to select parent or precursor ions within the ion guide or ion trap and to eject other ions from the ion guide or ion trap;

means arranged and adapted to fragment the selected parent or precursor ions within the ion guide or ion trap so as to generate a plurality of fragment ions;

oscillation means arranged and adapted to cause at least some of the fragment ions to oscillate in an axial direction in a mode of operation; and detector means for determining the frequency of oscillations of the fragment ions in the axial direction.

According to an aspect of the present invention there is provided a method of mass spectrometry comprising:

providing an ion guide or ion trap comprising a plurality of electrodes, the ion guide or ion trap having a longitudinal axis;

selecting parent or precursor ions within the ion guide or ion trap and ejecting other ions from the ion guide or ion trap;

fragmenting the selected parent or precursor ions within the ion guide or ion trap so as to generate a plurality of fragment ions;

causing at least some of the fragment ions to oscillate in an axial direction in a mode of operation; and determining the frequency of oscillations of the fragment ions in the axial direction.

According to an aspect of the present invention there is provided a mass spectrometer comprising:

an ion guide or ion trap comprising an axially segmented multipole rod set; and means arranged and adapted to maintain a quadratic DC potential well along at least a portion of the axial length of the ion guide or ion trap in a mode of operation so as to cause ions to undergo simple harmonic motion within the ion guide or ion trap.

Preferably, the mass spectrometer further comprises means arranged and adapted to resonantly eject ions from the quadratic DC potential well.

According to an aspect of the present invention there is provided a method of mass spectrometry comprising:

providing an ion guide or ion trap comprising an axially segmented multipole rod set; and maintaining a quadratic DC potential well along at least a portion of the axial length of the ion guide or ion trap in a mode of operation so as to cause ions to undergo simple harmonic motion within the ion guide or ion trap.

Preferably, the method further comprises resonantly ejecting ions from the quadratic DC potential well.

The preferred embodiment relates to a mass spectrometer comprising a linear ion guide or ion trap comprising a plurality of electrodes. An AC or RF voltage is preferably applied to the electrodes in order to radially confine ions along the axis of the preferred ion guide or ion trap. An electrostatic DC axial field is preferably also superimposed preferably symmetrically about a reference point along the axis of the preferred ion guide or ion trap.

The applied DC electrostatic field preferably exerts a force on ions within the preferred ion guide or ion trap and preferably accelerates ions towards the reference point. The force exerted on the ions is preferably proportional to the displacement of the ions from the reference point. Accordingly, ions are preferably caused to oscillate and undergo simple harmonic motion about the reference point.

According to the preferred embodiment the frequency of the ion oscillations about the reference point may be measured directly or indirectly preferably using one or more inductive or capacitive listening plates or detectors. A signal produced by the one or more inductive or capacitive listening plates or detectors is then preferably subjected to Fourier transform analysis. The resulting frequency domain information is then preferably used to produce a mass spectrum since the frequency of ion oscillation is preferably directly dependent upon the mass or mass to charge ratio of the ions undergoing oscillations.

In the preferred embodiment the DC axial superimposed electric field along the preferred ion guide or ion trap is preferably substantially linear. Accordingly, the voltage or potential maintained along the preferred ion guide or ion trap is preferably substantially quadratic.

According to a particularly preferred embodiment the ion guide or ion trap preferably comprises a segmented multipole rod set, preferably a quadrupole rod set. However, according to other embodiments the ion guide or ion trap may comprise other forms of ion guides or ion traps including, for example, an ion tunnel or ion funnel ion guide or ion trap.

In the preferred embodiment ions are preferably introduced, pulsed, ejected or injected axially into the preferred ion guide or ion trap. Once ions have been trapped within the preferred ion guide or ion trap they are then preferably induced to oscillate with a harmonic motion in the axial direction. The frequency of the axial motion may be determined using one or more inductive or capacitive detectors. According to the preferred embodiment the one or more detectors are preferably arranged along the axis of the ion guide or ion trap. The time domain data recorded by the one or more detectors is preferably transformed to the frequency domain using a fast Fourier transform technique. The frequency domain data is then preferably converted to a mass spectrum by applying an appropriate calibration expression or function to the data.

The preferred ion guide or ion trap preferably incorporates both radial confinement of ions due to an AC or RF voltage applied to the electrodes forming the ion guide or ion trap together with a superimposed DC axial potential well which is preferably maintained along the length of the ion guide or ion trap. This preferably leads to several important advantages over known arrangements.

Firstly, ions may be introduced or ejected into the preferred ion guide or ion trap and will preferably be confined or contained by the radial pseudo-potential well due to the AC or RF voltage applied to the electrodes forming the preferred ion guide or ion trap. Ions are also preferably trapped axially within the preferred ion guide or ion trap by the application of a DC electrostatic potential at one or both ends of the ion guide or ion trap.

Advantageously, ions may be cooled to thermal energies by the introduction of collision gas to the ion guide or ion trap before a quadratic axial DC potential is applied to the ion guide or ion trap in order to cause the ions to undergo axial oscillations. The thermal cooling of the ions according to the preferred embodiment allows the spatial and energy spread of the ions to be a minimum prior to the application of an axial DC quadratic potential and subsequent mass analysis of the ions.

The quadratic axial DC potential may be applied or altered so that a small amount of axial energy is imparted to the cooled ions. The low initial energy spread ensures that ions of the same mass to charge ratio values oscillate in the axial direction in coherent groups allowing accurate determination of the axial oscillation frequency for a given mass to charge ratio.

According to an alternative or additional embodiment, ions may be cooled to thermal energies externally to the ion guide or ion trap. For example, the ions may be thermally cooled in a further ion guide or ion trap arranged upstream or downstream of the ion guide or ion trap according to the preferred embodiment. The thermally cooled ions may then be pulsed or otherwise injected into the ion guide or ion trap from the further ion guide or ion trap with a suitable, pre-defined, axial energy.

Secondly, ions are preferably radially confined within the preferred ion guide or ion trap by the pseudo-potential well created by the AC or RF voltage applied to the electrodes of the preferred ion guide or ion trap. For ions within the characteristic stability region for the particular multi-pole at the RF and DC conditions used, very few if any radial losses of ions will occur. Higher order (e.g. hexapole) multi-pole devices offer even more efficient radial confinement and higher charge capacity due to the increased width of the pseudo-potential well created.

Thirdly, the energy spread and entrance angle for ions entering the preferred ion guide or ion trap is less critical than for a purely electrostatic harmonic oscillators or Orbitrap mass spectrometers. According to the preferred embodiment, ions are preferably arranged to enter the preferred ion guide or ion trap substantially on axis and hence at the lowest part of the radial pseudo-potential well. The ions are therefore efficiently contained or confined within the preferred ion guide or ion trap prior to analysis.

Fourthly, collisions between ions and residual gas molecules will reduce the energy of the ions in the axial direction leading to smaller and smaller amplitude oscillations. However, this effect will not though lead to losses of the ions from the preferred ion guide or ion trap. According to the preferred embodiment once the amplitude of oscillations has dropped to a certain level where ion detection is no longer possible or where it becomes inaccurate, collision gas may be re-introduced into the preferred ion guide or ion trap to cool the ions. The analysis process may then be started again. In this way the same packet of ions may be analysed repeatedly with very low losses to improve the precision of the frequency measurements.

Fifthly, ions may be mass selectively resonantly excited and/or ejected axially from the preferred ion guide or ion trap by the super-position of a small excitation AC or RF voltage waveform of the appropriate frequency and magnitude on top of or in addition to the axial DC potential applied to the preferred ion guide or ion trap which causes ions to undergo simple harmonic motion within the preferred ion guide or ion trap. According to an additional or alternative embodiment, ions may be ejected radially from the preferred ion guide or ion trap by applying an RF excitation voltage to the electrodes forming the preferred ion guide or ion trap. Mass selective ejection may also be used by adjusting the amplitude of the AC or RF voltage used to radially confine ions within the ion guide or ion trap and/or the DC voltage applied to electrodes forming the preferred ion guide or ion trap.

Sixthly, the preferred ion guide or ion trap has the advantage that the axial DC voltage which is preferably applied to the electrodes forming the preferred ion guide or ion trap may be removed either before and/or after analysis of the ions. The ion guide or ion trap may therefore be used in other modes of operation as a conventional ion guide, ion trap or mass analyser.

Various embodiments of the present invention will now be described, by way of example only, and with reference to the accompanying drawings in which.

Figure 1:
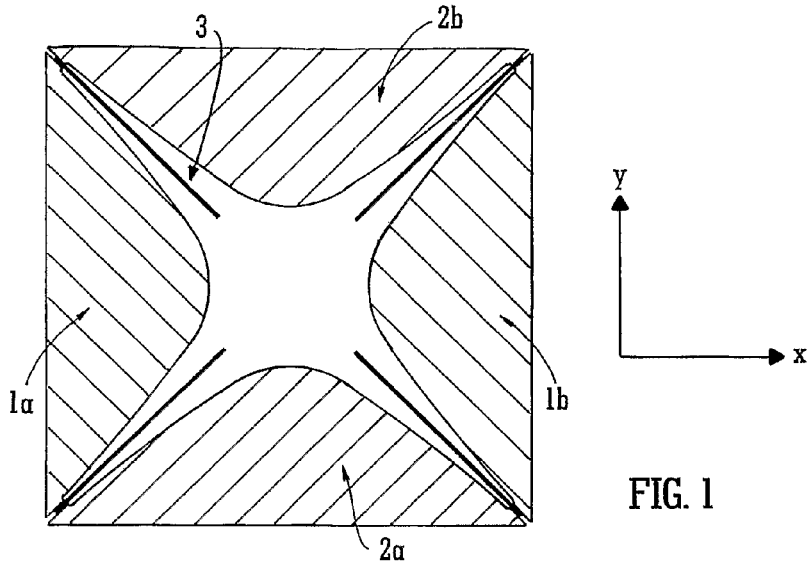
FIG. 1 shows a cross-sectional view of a preferred ion guide or ion trap showing inductive or capacitive listening plates located in zero potential planes.

A preferred ion guide or ion trap will now be described with reference to FIG. 1. According to an embodiment the ion guide or ion trap preferably comprises a segmented quadrupole rod set assembly. The quadrupole rod set assembly preferably comprises two pairs of rods 1*a*, 1*b*; 2*a*, 2*b* having hyperbolic surfaces. A first pair of hyperbolic rod electrodes 1*a*, 1*b* and a second pair of hyperbolic rod electrodes 2*a*, 2*b* are shown in FIG. 1.

Figure 2:
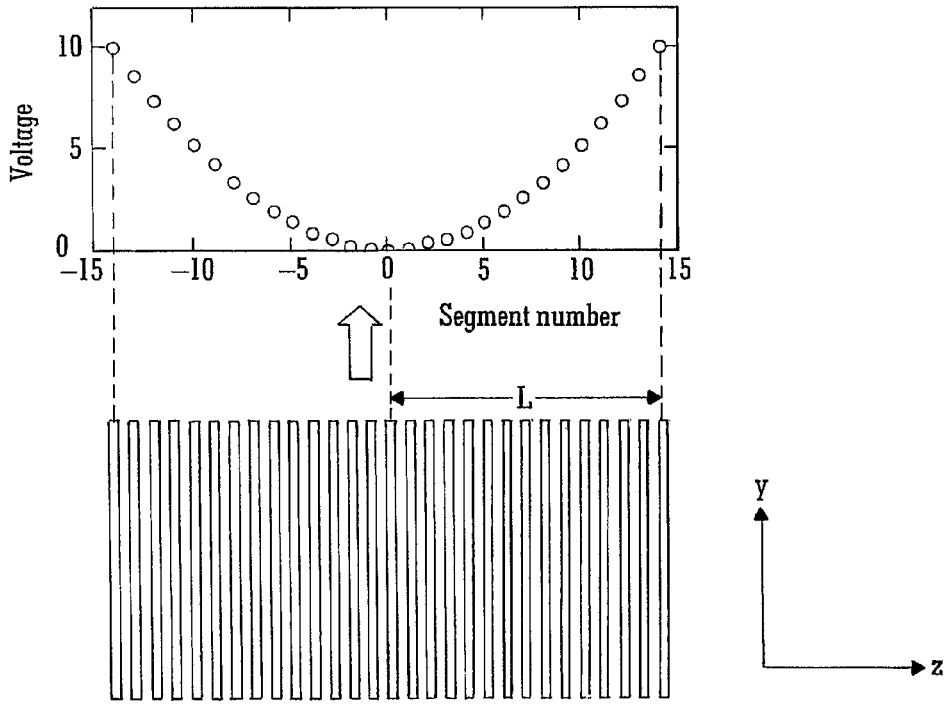
FIG. 2 shows a side view of a preferred ion guide or ion trap and illustrates a quadratic DC potential which is preferably applied to the segments of the preferred ion guide or ion trap.

The preferred ion guide or ion trap is preferably segmented in the axial direction. FIG. 2 shows the preferred ion guide or ion trap viewed in the y,z plane and shows 29 individual axial segments. FIG. 2 also shows different DC or electrostatic potentials or voltages which are preferably applied to each axial segment of the preferred ion guide or ion trap. According to the preferred embodiment the DC voltage applied to each axial segment is in the range 0-10 V.

According to the preferred embodiment in a mode of operation a quadratic, approximately quadratic or substantially quadratic DC or electrostatic potential is preferably maintained along at least a portion of the axial length of the preferred ion guide or ion trap.

In operation an AC or RF voltage is also preferably applied to the four hyperbolic rods 1*a*, 1*b*, 2*a*, 2*b* which preferably form each axial segment in order to create a radial pseudo-potential well. The radial pseudo-potential well preferably acts to confine ions radially in the x,y direction within the preferred ion guide or ion trap. Opposed rods are preferably connected to the same phase of an AC or RF voltage supply and neighbouring rods are preferably connected to opposite phases of the AC or RF voltage supply.

The potential applied to the first pair of electrodes or rods 1*a*, 1*b* is preferably given by:

$$\phi_1=\phi_0\cos(\Omega\cdot t)$$

The potential applied to the second pair of electrodes or rods 2*a*, 2*b* is preferably given by:

$$\phi_2=-\cos(\Omega\cdot t)$$

wherein $\phi_0$ is the 0-peak voltage of a radio frequency high voltage power supply, t is time in seconds and Ω is the angular frequency of the AC or RF voltage supply in radians/second.

The potential in the x,y direction may therefore be given as:

$$\phi_{x,y}=\phi_o\cos(\Omega\cdot t)\frac{(x^2-y^2)}{2\cdot r_o^2}$$

wherein $r_0$ is the radius of an imaginary circle enclosed within or inscribed by the two pairs of rods or electrodes 1*a*, 1*b*; 2*a*, 2*b*.

Ion motion in the x,y axis (radial direction) may be expressed in terms of a Mathieu type equation. The ion motion comprises of low amplitude micro-motion with a frequency related to the initial RF drive frequency and a larger secular motion with a frequency related to the mass to charge ratio of the ion.

The properties of this equation are well known and solutions resulting in stable ion motion are generally represented using a stability diagram by plotting the stability boundary conditions for the dimensionless parameters $a_u$ and $q_u$. For this particular embodiment:

$$a_u=a_x=-a_y=\frac{8qU_0}{m\Omega^2r_0^2}$$

$$q_u=q_x=-q_y=\frac{4q\phi_0}{m\Omega^2r_0^2}$$

where m is the molecular mass of the ion, $U_0$ is a DC voltage applied to one of the pairs of electrodes or rods 1*a*, 1*b*; 2*a*, 2*b* and q is the electron charge e multiplied by the number of charges on the ion z:

$$q=z\cdot e$$

The operation of a quadrupole rod set mass analyser is well known.

The application of an AC or RF voltage to the rods or electrodes 1*a*, 1*b*, 2*a*, 2*b* results in the formation of a pseudo-potential well in the radial direction. An approximation of the pseudo-potential well in the x-direction may be given by:

$$V^*_{(x)}=\frac{q\cdot\phi_0^2\cdot x^2}{4\cdot\Omega\cdot m\cdot r_0^4}$$

The depth of the well is approximately:

$$\overline{D}_x=\frac{q_x\cdot\phi_0}{8}$$

for values of $q_z<0.4$.

As the quadrupole is cylindrically symmetrical an identical expression may be derived for the characteristics of the pseudo-potential well in the y-direction.

In addition to this AC or RF trapping potential in the radial direction, a quadratic electrostatic or DC voltage profile is preferably applied or maintained along the segments of the pairs of electrodes 1*a*, 1*b*, 2*a*, 2*b*. According to the preferred embodiment the applied DC potential is preferably at a minimum at substantially the centre of the axial length of the preferred ion guide or ion trap. However, according to less preferred embodiments the minimum of the axial potential well may be located either closer to the entrance of the preferred ion guide or ion trap or closer to the exit of the preferred ion guide or ion trap.

The DC or electrostatic potential or voltage maintained along the length of the preferred ion guide or ion trap is preferably arranged to increase as the square of the distance or displacement away from the minimum of the axial potential well (which preferably corresponds with the central region of the preferred ion guide or ion trap).

The DC potential applied to the preferred ion guide or ion trap in the z-direction is preferably of the form:

$$U_z=\frac{k\cdot z^2}{2}$$

where k is a constant.

The electric field $E_z$ in the z-direction is given by:

$$E_z=\frac{\delta U_z}{\delta z}=k\cdot z$$

The electric force $F_z$ in the z-direction is given by:

$$F_z=-q\cdot E_z=-q\cdot k\cdot z$$

The acceleration $A_z$ along the z-axis is given by:

$$A_z=\ddot{z}=-\frac{q}{m}\cdot k\cdot z$$

Accordingly, the restoring force on an ion within the preferred ion guide or ion trap is preferably directly proportional to the axial displacement of the ion from the centre of the superimposed DC potential well. Under these conditions the ion will be caused to undergo simple harmonic oscillation in the axial (z) direction.

The exact solution of the equation above is given by:

$$z(t)=z_0\cos(\omega\cdot t)+\sqrt{(2\cdot V/k}\cdot\sin(\omega\cdot t)$$

where V is the initial accelerating potential applied to the ion in the z-direction and $z_0$ is the initial z-coordinate of the ion. Also:

$$\omega=\sqrt{q\cdot k/m}$$

where ω is the angular frequency of the ion oscillations in the axial direction.

From the above equation it can be seen that the angular frequency of the ion oscillations in the axial direction is independent of the initial energy and starting position of the ion. The frequency of the ion oscillation is dependent solely upon the mass to charge ratio (m/q) of the ion and the electric field strength constant (k).

To satisfy the Laplace equation the potential in x,y,z directions due to the superimposed quadratic field is of the form:

$$U_{x,y,z} = \frac{k}{2}z^2 + A(x, y)$$

where $$\frac{\delta^2 x}{\delta x^2} + \frac{\delta^2 y}{\delta y^2} = -k$$

This condition implies that in superimposing a symmetrical static DC quadratic potential and thus a linear electric field along the axial (z) axis of the preferred ion guide or ion trap, then a static DC radial electric field is also developed. When ions experience this radial field they will be accelerated towards the outer electrodes 1*a*, 1*b*, 2*a*, 2*b*. However, the radial pseudo-potential well created by the application of an AC or RF voltage to the electrodes 1*a*,1*b*, 2*a*, 2*b* is preferably arranged to be sufficient to overcome the outward radial force exerted on the ions and hence the ions will preferably remain radially confined within the preferred ion guide or ion trap.

The preferred ion guide or ion trap is preferably constructed so that the radial and axial motions are not in any way coupled. The radial electric field will not therefore affect the conditions required for simple harmonic motion of ions in the axial direction.

The DC voltage applied to the electrodes forming each segment of the preferred ion guide or ion trap is preferably generated using individual low voltage DC power supplies. The outputs of the low voltage DC power supplies are preferably controlled by a programmable microprocessor.

According to the preferred embodiment the general form of the electrostatic potential function in the axial direction can thus preferably be rapidly manipulated. In addition complex and/or time varying voltage functions may be superimposed on the preferred ion guide or ion trap in the axial direction.

Ions are preferably introduced into the device via an external ion source either in a pulsed or a substantially continuous manner. During the introduction of a continuous beam of ions from an external source the initial axial energy of the ions entering the preferred ion guide or ion trap is preferably arranged so that all the ions of a specific mass to charge ratio range are radially confined by the radial AC or RF electric field and are trapped axially by superimposed axial DC electrostatic potentials. The electrostatic DC potential function in the axial direction may or may not be quadratic at this particular time.

The initial energy spread of the ions now confined within the preferred ion guide or ion trap may be reduced by introducing a cooling gas into the preferred ion guide or ion trap. The cooling gas is preferably introduced into the preferred ion guide or ion trap and is preferably maintained at a pressure in the range $10^{-4}$-$10^{-1}$ mbar or more preferably in the range $10^{-3}$-$10^{-2}$ mbar.

The ions confined within the preferred ion guide or ion trap will preferably lose kinetic energy in collisions with the gas molecules and the ions will preferably quickly reach thermal energies. As a result of the thermal cooling of the ions, the ions confined within the preferred ion guide or ion trap and which preferably have differing mass to charge ratios are preferably caused to migrate to the point of lowest electrostatic potential along the axis of the preferred ion guide or ion trap.

The point at which the ions preferably migrate to may be the same or may be different to the position of the minimum potential when subsequently a quadratic electrostatic potential is preferably applied along at least a portion of the length of the preferred ion guide or ion trap.

According to the preferred embodiment the collisional cooling of the ions ensures that the spatial and energy spread of the ions will be minimised. Ions of the same mass to charge ratio values will also preferably be coherent with each other (in phase) as they undergo subsequent oscillations within the preferred ion guide or ion trap.

In the preferred embodiment the electrostatic or DC potential which is preferably applied to the preferred ion guide or ion trap prior to the application of quadratic potential is preferably arranged so that the ions are trapped at a position along the z-axis which is preferably displaced from the minimum point of the subsequently applied quadratic electrostatic potential. This ensures that ions are accelerated towards the minimum of the quadratic potential when the quadratic potential is subsequently applied.

Ions may be introduced into the preferred ion guide or ion trap from an external continuous or pulsed ion source. Ions received from the ion source may first be trapped within the preferred ion guide or ion trap, for example, by the application of electrostatic potentials at each end of the preferred ion guide or ion trap. The ions trapped within the preferred ion guide or ion trap may then be subsequently moved to a specific location within the preferred ion guide or ion trap by the application of a suitable superimposed electrostatic potential to the electrodes forming the preferred ion guide or ion trap.

The initial trapping stages of ions within the preferred ion guide or ion trap may be accomplished in the absence of or, more preferably, in the presence of cooling gas. The initial trapping potentials are not required to follow a quadratic function in the axial direction.

Once the ions have been trapped within the preferred ion guide or ion trap and preferably sufficiently cooled to minimise initial spatial and energy spread, the DC electrostatic potential applied to the electrodes forming the preferred ion guide or ion trap is then preferably rapidly changed so that a preferably symmetrically disposed quadratic potential is maintained along the length of the preferred ion guide or ion trap. The minimum of the quadratic potential is preferably displaced in the axial direction from the initial position of the ions within the preferred ion guide or ion trap when the DC quadratic potential is applied to the preferred ion guide or ion trap.

As a result of the minimum of the applied DC quadratic potential being different from the initial starting position of ions within the preferred ion guide or ion trap, ions within the preferred ion guide or ion trap will begin to be accelerated towards the minimum of the applied quadratic potential and will execute simple harmonic motion about a reference point corresponding with the minimum of the quadratic potential.

By varying the initial starting point of the ions with respect to the minimum of the quadratic electrostatic potential, the initial accelerating potential and hence the amplitude of the harmonic oscillations can be controlled.

In another, less preferred embodiment, ions may be initially trapped and collisionally cooled at a point in the device corresponding to the minimum of the quadratic electrostatic potential which is subsequently applied to the electrodes forming the preferred ion guide or ion trap. According to this less preferred embodiment, axial harmonic motion is then preferably initiated by first removing the cooling gas and then preferably altering the DC axial field to impart a controlled axial accelerating force away from the central region of the preferred ion guide or ion trap. Once ions have been accelerated away from the central region of the preferred ion guide or ion trap, then a DC quadratic axial potential is then preferably applied to the electrodes forming the preferred ion guide or ion trap and as a result ions are preferably caused to oscillate along the z-axis.

According to the preferred embodiment ions of the same mass to charge ratio value will preferably oscillate as a well-defined group.

Collisions with residual gas molecules will eventually cause the amplitude of the oscillations to decrease and ions will slowly begin to collapse towards the central region of the applied axial DC potential well. However, although the ions may slowly lose energy they will not be lost to the system as they will remain radially confined by the pseudo-potential well due to the applied AC or RF voltage.

Once ions within the preferred ion guide or ion trap have lost energy and have migrated to the minimum of the axial potential well (preferably located towards the central region of the preferred ion guide or ion trap), the ions may then be thermally cooled again by re-introducing collision gas into the preferred ion guide or ion trap. The ions may then be re-analysed multiple times by repeating the method described above.

According to an embodiment, instead of thermally cooling ions within the preferred ion guide or ion trap, ions may additionally or alternatively be thermally cooled in a device such as an ion guide or ion trap which is preferably external to the preferred ion guide or ion trap. The ions may then be pulsed into the preferred ion guide or ion trap with a narrow spatial and energy spread at a defined axial energy. Axial harmonic oscillations can then be arranged to start immediately.

In the preferred embodiment the frequency of the ion oscillations is preferably detected using image current detection. As shown in FIG. 1*a* set of listening plates 3 may be preferably placed within the preferred ion guide or ion trap preferably along the zero potential planes of the RF quadrupole device. This arrangement ensures that there is minimal disruption to the RF containment field in the radial direction and minimises the extent of electrical pickup onto the listening plates 3. However, according to other less preferred embodiments the listening plates 3 may be located in different positions either within the preferred ion guide or ion trap or external to the preferred ion guide or ion trap.

The principles of differential image current detection are well known. Reference is made, for example, to "Signal Modelling for ion cyclotron resonance" by Melvin B. Comisarow, J. Chem. Phys. 69 (9), 1 Nov. 1978. In order to illustrate the principles involved, upper and lower infinite flat parallel plates separated by a distance d may be considered. An ion of charge q is considered to be oscillating between the plates with frequency ω and maximum amplitude from the centre of the plates r. The position of the ion may be described as:

$$y(t)=r\cdot\cos(\omega\cdot t)$$

The instantaneous charge Q(t) induced by the ion on the upper plate is given by:

$$Q(t)=\frac{-N\cdot q\cdot r\cdot\cos(\omega\cdot t)}{d}$$

wherein N is the number of ions, q is the charge on the ion and ω is the frequency of oscillation.

The current I(t) induced by the ion on the upper plate at time t is given by:

$$I(t)=\frac{\partial Q}{\partial t}=\frac{N\cdot q\cdot r\cdot\omega\cdot\sin(\omega\cdot t)}{d}$$

It will be appreciated that the magnitude of the current induced depends upon the frequency of oscillation (rate of change of charge) ω, the proximity of the ion to the listening plate r/d, and the number of ions N.

Detection and recording of this induced current requires that the signal be converted into a voltage. This can be accomplished by connecting the two plates with a suitable shunt resistor and associated low noise electronics and amplifier circuit.

To estimate the induced charge for other more complex electrode geometries other numerical or analytical methods may be employed. This process involves computing the electric field from a point charge (ion) as a function of position. The surface charge density induced on each of the surrounding electrodes may then be calculated. Based upon the known trajectory of the ion within the ion trap the time dependence of the induced charge on the detection electrodes can be estimated.

Reference is made to "Comprehensive theory of Fourier transform ion cyclotron resonance signal for all ion trap geometries" by P Grosshans et al., J. Chem. Phys. 94 (8), 15 Apr. 1991.

Figure 3:
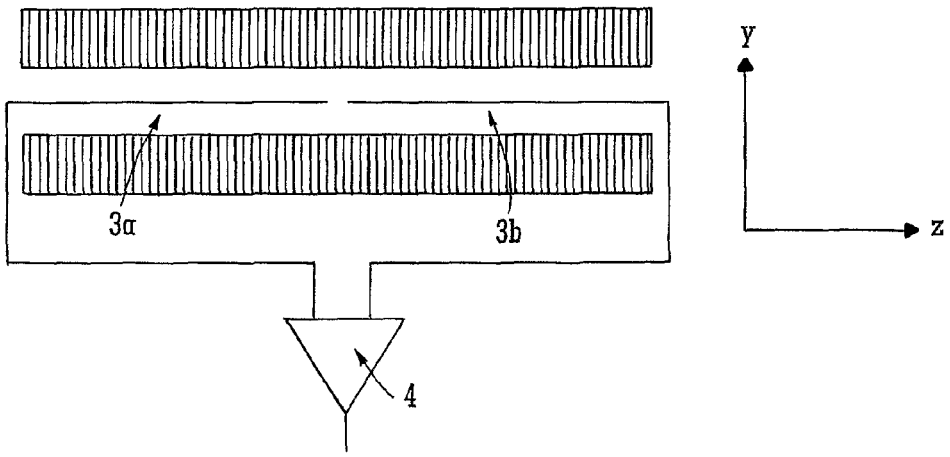
FIG. 3 shows a side view of an ion guide or ion trap according to an embodiment wherein inductive or capacitive listening plates are located substantially along the length of the ion guide or ion trap.

FIG. 3 shows the positioning of inductive listening plates 3*a*, 3*b* according to an embodiment of the present invention. The listening plates 3*a*, 3*b* are shown split at the central region of the preferred ion guide or ion tunnel. The signal due to ion oscillations within the ion guide or ion tunnel is detected on the two sets of listening plates 3*a*, 3*b* and is preferably amplified by a differential amplifier 4.

According to an alternative embodiment the listening plates 3*a*, 3*b* may themselves be segmented. According to an embodiment, the listening plates 3*a*, 3*b* may be formed into a similar or substantially the same number of segments as the number of segments of the preferred ion guide or ion trap over which the axial quadratic potential is preferably applied. According to this embodiment a DC voltage may be applied to each segment of the listening plates which is preferably similar or identical to the DC voltage applied to the segment of the preferred ion guide or ion tunnel closely associated with it. In this way the axial quadratic DC potential is preferably undisturbed by the presence of the listening plates.

According to an embodiment one or more, or several of the individual segmented listening plates may be utilised independently to measure the frequency of ion oscillation. The resultant signals may then be combined either before or after processing from the time to frequency domain thereby improving signal to noise.

The image current detected according to the preferred embodiment will preferably be due to the simple harmonic oscillations of ions in the axial direction superimposed with the secular frequency of the ions in the radial direction. However, ions having the same mass to charge ratio moving in the radial direction will be randomly distributed and so will tend to be out of phase with each other. As a result, the contribution of the radial motion component in the final frequency spectrum will be minimal.

The time domain data detected by the inductive or capacitive detectors according to the preferred embodiment and preferably recorded is then preferably processed using Fast Fourier Transform (FFT) analysis in order to produce a frequency spectrum. The frequency determined by the Fourier Transform analysis will be directly related to mass to charge ratio of the ion undergoing simple harmonic motion within the preferred ion guide or ion trap.

According to an embodiment the mass to charge ratio of an ion may be determined by comparing its frequency with the frequency of another ion which has a known mass to charge ratio.

According to the preferred embodiment high quality, high-resolution mass spectral data may be produced. Furthermore, the resolution of the mass spectrometer will increase with the number of oscillations recorded.

Figure 4:
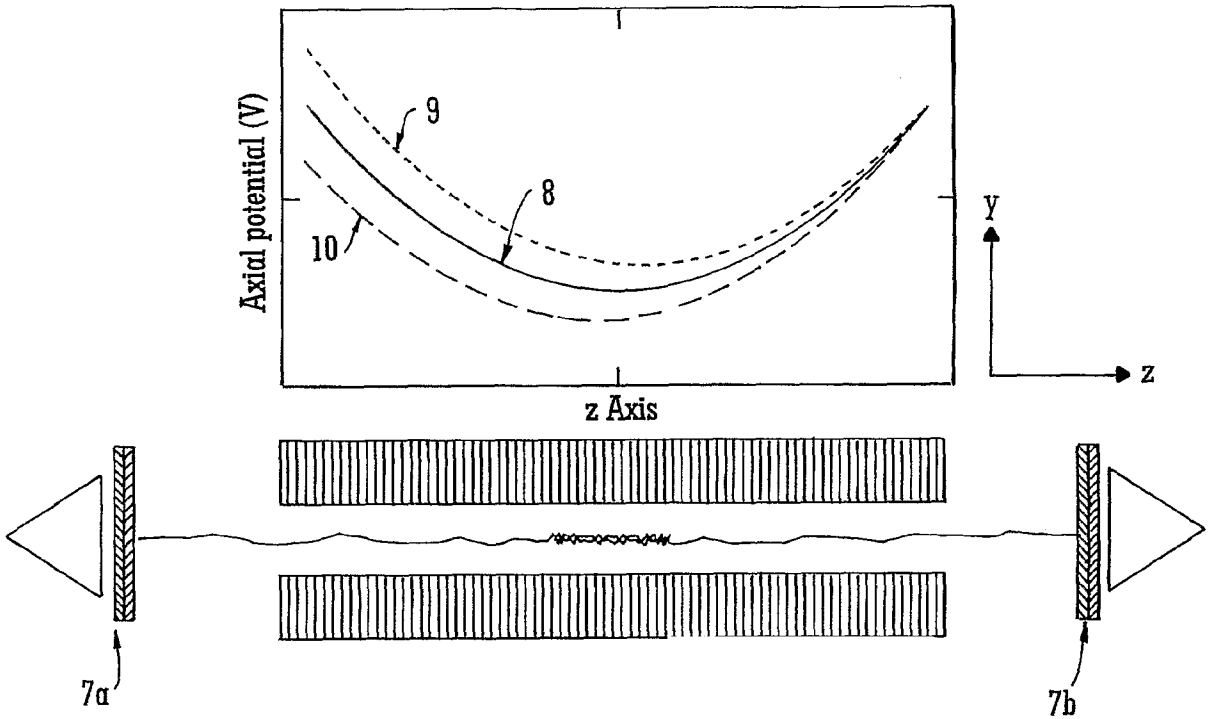
FIG. 4 illustrates a method of resonantly ejecting ions from the preferred ion guide or ion trap by varying the DC potential profile along the length of the preferred ion guide or ion trap.

In addition to the Fourier Transform mode of operation described above it is also possible to use the preferred ion guide or ion trap in a different mode of operation wherein ions are resonantly ejected in an axial manner from the preferred ion guide or ion trap. This alternative mode of operation will now be described with reference to FIG. 4. FIG. 4 shows a representation of the preferred ion guide or ion trap viewed in the y,z plane showing a segmented quadrupole rod set. FIG. 4 also shows the applied DC axial potential at three different times along the z-axis of the preferred ion guide or ion tunnel.

The solid line 8 in FIG. 4 illustrates a symmetrical quadratic DC potential which is preferably maintained along the length of the preferred ion guide or ion trap at an initial time $t_0$. Accordingly, at time $t_0$ ions will be caused to undergo simple harmonic motion in the axial direction with an amplitude dependent upon their initial kinetic energy and position (or the total of the kinetic and potential energy) with a frequency inversely related to the square root of their mass.

According to this particular embodiment at a later time $t_1$ the DC axial potential is preferably altered to the potential profile indicted by dashed line 9. At a yet later time $t_2$ the DC axial potential is again altered to the potential profile indicated by dashed line 10. It will be appreciated that $t_0<t_1<t_2$.

The modification to the symmetrical quadratic potential as indicated by solid line 8 in FIG. 4 may be generated by the addition of a small linear term to the original quadratic expression. In particular, the DC potential in the z-axis may be arranged to be time varying and of the form:

$$U_z = \frac{k}{2}(z^2 + b \cdot \cos(\omega \cdot t) \cdot z)$$

where b is a constant, ω is the resonant frequency of the ion of interest and t is time.

According to other embodiments the DC potential may be varied in alternative ways in order to achieve resonance ejection. For instance, the voltage may be modified such that the electric field always remains linear on both sides of the minimum of the potential well but has differing field gradients. In this case the gain factor k within the expression describing the potential on one side of the potential well is preferably arranged to be different to the expression governing the opposite side of the potential well.

Resonance may also be introduced by adding small amounts of higher order terms into the original quadratic expression. For example, for a third order the equation is given below:

$$U_z = \frac{k}{2}(z^2 + b \cdot \cos(\omega \cdot t) \cdot z^3)$$

Using these higher order terms non-linear resonances may be induced.

If the fluctuation of the field is repeated at a frequency matching the oscillation frequency of ions having a certain mass to charge ratio value then these ions will preferably gain energy and the amplitude of their oscillations will preferably increase. These ions will then preferably be caused to be resonantly ejected from the preferred ion guide or ion trap in the axial direction. Ions ejected from the preferred ion guide or ion trap may then be detected using one or more conventional ion detectors. The voltage fluctuations applied to the superimposed axial DC potential in order to cause resonant ion ejection in the axial direction is preferably in the order of tens of mV.

FIG. 4 shows an embodiment wherein two microchannel plate detectors 7*a*, 7*b* are provided, one at either end of a preferred ion guide or ion trap. According to another embodiment ions may be arranged to be resonantly ejected from the preferred ion guide or ion trap from either the entrance or the exit of the preferred ion guide or ion trap by suitable manipulation of the superimposed axial DC potentials in which case only a single ion detector may be required.

According to embodiments of the present invention different forms of ion multiplier may be used for ion detection. For example, channeltron or discrete dynode electron multipliers may be used. Photo-multipliers or various different combinations of these types of detectors may be used.

According to an embodiment the frequency of the axial field oscillations are preferably scanned thereby enabling a full mass spectrum to be generated as ions having differing mass to charge ratios are progressively resonantly ejected from the preferred ion guide or ion trap.

In addition to a MS mode of operation the preferred ion guide or ion trap may also be used for $MS^n$ experiments wherein specific parent or precursor ions are selected for subsequent fragmentation. The selected parent or precursor ions are then fragmented so as to form a plurality of fragment ions. The fragment ions may then preferably be mass analysed. Mass analysis of the fragment ions enables important structural information relating to the parent or precursor ions to be determined.

In the preferred embodiment selection of a parent or precursor ion having a specific mass to charge ratio value may be accomplished using the axial resonance ejection mode described above. For example, a broad band of excitation frequencies may be applied simultaneously to the axial DC voltage in order to resonantly eject the majority of ions from the preferred ion guide or ion trap. All ions with the exception of the precursor or parent ions of interest are thus axially ejected from the preferred ion guide or ion trap.

In order to resonantly eject all ions from the preferred ion guide or ion trap apart from specific parent or precursor ions of interest a method of inverse Fourier transform may be employed. This enables a suitable superimposed waveform to be generated for resonance ejection of a broad range of ions whilst leaving specific ions within the preferred ion guide or ion trap.

Once all ions apart from parent or precursor ions of interest have been ejected from the preferred ion guide or ion trap, the parent or precursor ions of interest are then preferably fragmented. In order to fragment precursor or parent ions of interest a collision gas is preferably reintroduced into the preferred ion guide or ion trap. Once a collision gas has been preferably reintroduced then an excitation frequency preferably corresponding to the harmonic frequency of the parent ions of interest is preferably added to the axial DC voltage. This preferably causes the parent or precursor ions of interest to fragment and the resulting fragment or daughter ions may then be mass analysed. The fragment or daughter ions may be mass analysed by causing them to execute simple harmonic motion within the preferred ion guide or ion trap and measuring the frequency of oscillations using the inductive detectors and subsequent Fourier Transform analysis. Alternatively, the fragment or daughter ions may be mass analysed by operating the preferred ion guide or ion trap in a resonance ejection mode of operation.

This process of selection and excitation may be repeated thereby enabling $MS^n$ experiments to be performed. For example, specific fragment or daughter ions may be retained within the preferred ion trap or ion guide whilst all other fragment or daughter ions may be resonantly ejected from the preferred ion guide or ion trap. The specific fragment or daughter ions may then be subjected to further fragmentation in a similar manner as described above in relation to specific precursor or parent ions.

According to an embodiment precursor or parent ion selection may be achieved using the well known radial stability characteristics of an RF quadrupole. Application of a dipolar resonance voltage or resolving DC voltage may be used in order to reject ions having certain mass to charge ratios either as ions enter the preferred ion guide or ion trap or once the ions are trapped within the preferred ion guide or ion trap.

According to an embodiment resonance excitation in the radial direction may be employed either alone or in conjunction with axial excitation to fragment ions within the preferred ion guide or ion trap.

An embodiment of the present invention was modelled using SIMION® ion optics software. Hyperbolic quadrupole rods were modelled having an inscribed radius of 5 mm. The length of the rods was modelled as being 116 mm. The peak amplitude of the RF voltage applied to the rods was set at 200 V. The angular frequency of the RF voltage applied to the rods was set at $6.283\times10^6$ rad/sec. The rods were divided into 59 discrete axial segments each having a width of 1 mm with an inter-segment spacing of 1 mm.

Figure 5:
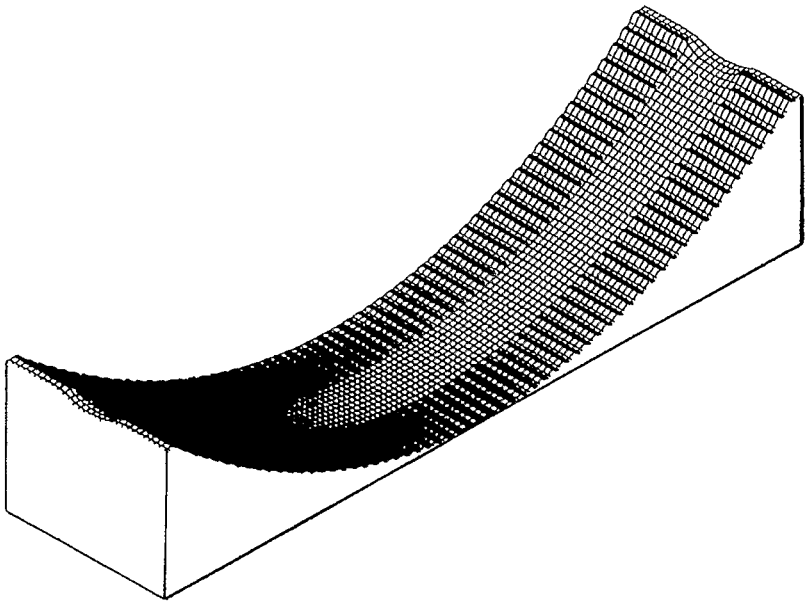
FIG. 5 shows a SIMION® electrostatic potential plot in the x,z plane for y=0 showing the DC potential applied to the preferred ion guide or ion trap.

RF potentials were applied to all the electrodes of all the segments and DC potentials were applied along all the 59 segments with magnitudes which followed a quadratic function. The superimposed DC on the centermost segment was set at 0V. The superimposed DC potential on the two outermost segments was set at 42.908 V. FIG. 5 shows a potential energy plot generated from the SIMION® modelling with only DC potential applied to the segmented rods. The plot illustrates the quadratic potential energy surface in the x,z plane for y=0.

Figure 6:
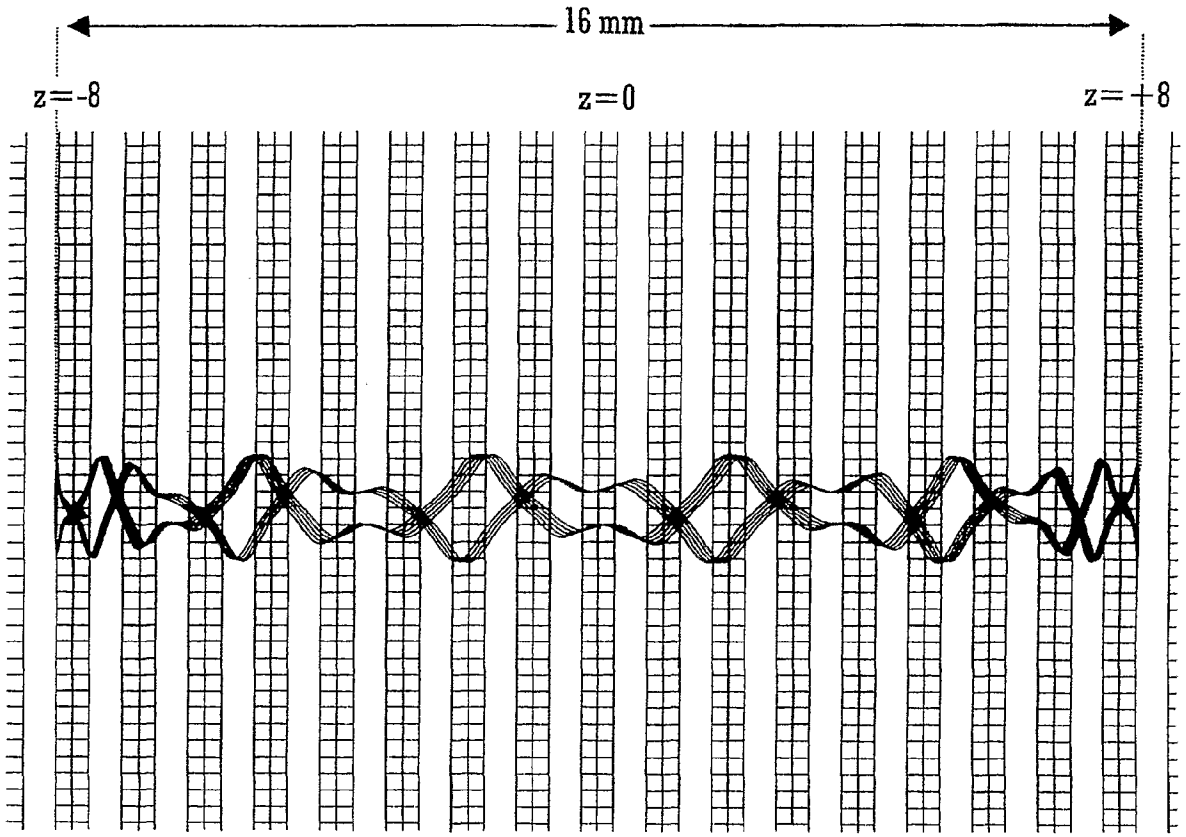
FIG. 6 shows the path of an ion having a mass to charge ratio of 100 and which performs five axial oscillations within the preferred ion guide or ion trap.

FIG. 6 shows the path traced by an ion having a mass to charge ratio of 100. A small 16 mm central portion of the overall 116 mm long preferred ion guide or ion trap is shown in FIG. 6. As can be seen from FIG. 6, the ion is trapped within this small 16 mm central portion of the preferred ion guide or ion tunnel. The initial position of the ion was set at z=0 and x=y=0.5 mm. The ion was given an initial energy in the positive z-direction of 3.5 eV and was allowed to oscillate for five complete cycles. The maximum oscillation was determined as having a length measured in the z-direction of 16.6 mm. The characteristic secular motion associated with RF confinement in x and y directions can be seen superimposed onto the path of the ion. The width of the envelope resulting from the ion in the y-direction was 3 mm.

Figure 7:
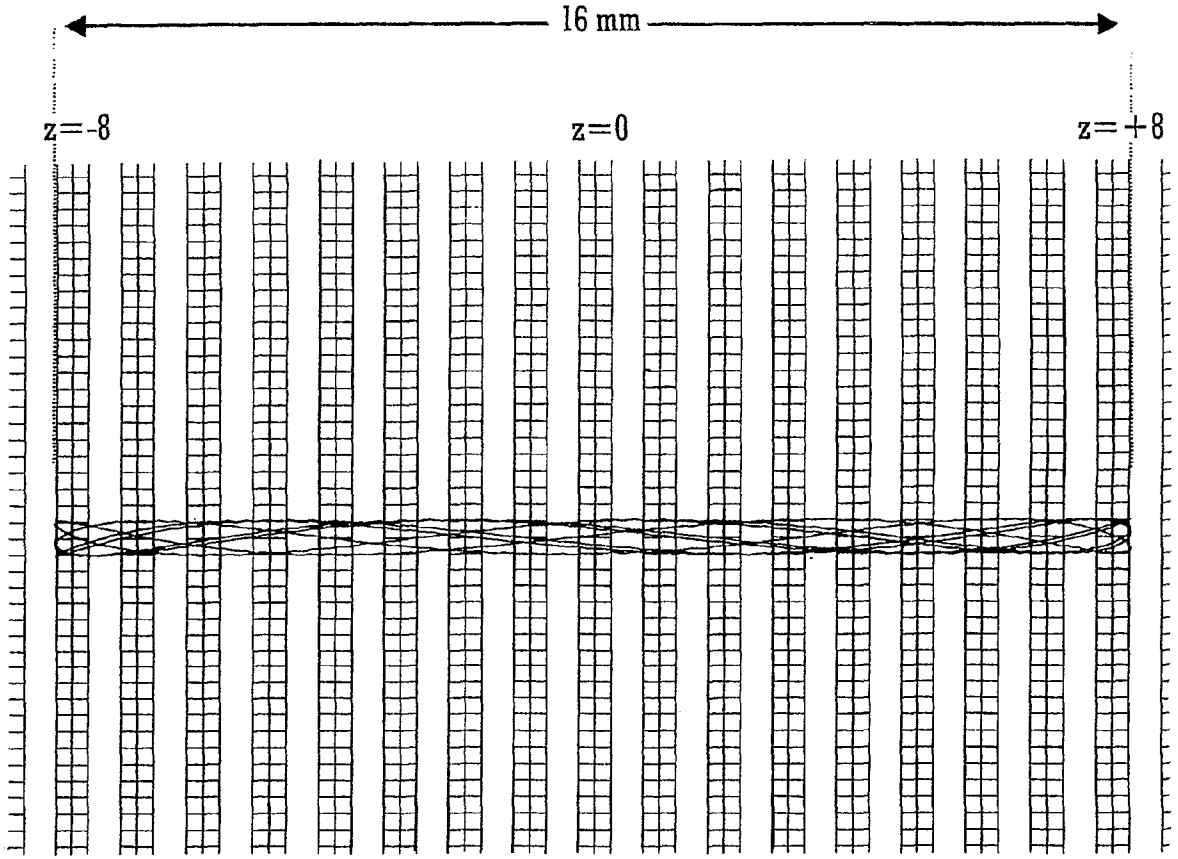
FIG. 7 shows the path of an ion having a mass to charge ratio of 1000 and which performs five axial oscillations within the preferred ion guide or ion trap.

FIG. 7 shows the path traced by an ion having a higher mass to charge ratio of 1000. A small 16 mm central portion of the overall 116 mm long preferred ion guide or ion trap is shown in FIG. 7. The initial position of the ion was set at z=0 and x=y=0.5 mm. The ion was given an initial energy in the z-direction of 3.5 eV and allowed to oscillate for five complete cycles. The maximum oscillation was determined as having a length measured in the z-direction of 16.6 mm. The characteristic secular motion associated with RF confinement in x and y directions is of lower frequency and amplitude than that observed in FIG. 6 as expected. The width of the envelope resulting from the ion in the y-direction was smaller and was only 1 mm.

Figure 8:
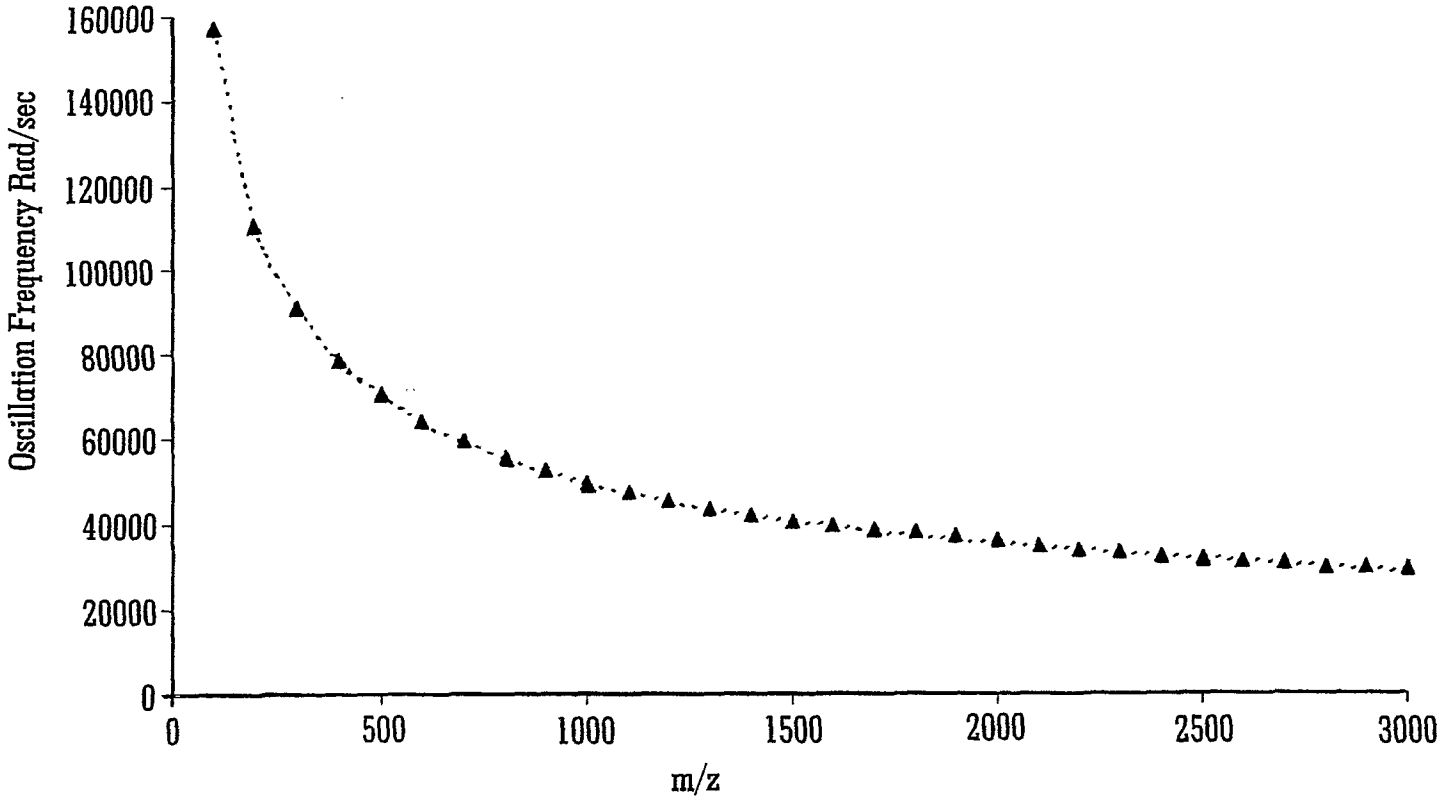
FIG. 8 shows a plot of the average frequency of oscillation in the axial direction as a function of mass to charge ratio wherein the theoretically calculated frequency is shown as a dotted line.

FIG. 8 shows the determined mean frequency of oscillations of ions as a function of mass to charge ratio value for the particular conditions described above in relation to the embodiment described with reference to FIGS. 6 and 7. The frequency was measured by recording the time at which an ion crosses the z=0 plane. The points on this plot represent frequency measurements taken directly from the SIMION® modelling. The dotted line represents the theoretical frequency for each mass to charge ratio based upon the equation governing simple harmonic motion and assuming a perfect quadratic electrostatic potential function. The starting conditions for each measurement were identical to those described in relation to the embodiments described above with reference to FIGS. 6 and 7. The close correlation between the measured and theoretical values indicates that, for this model, the field is close to ideal for harmonic motion within a 3 mm diameter of the centre of the preferred ion guide or ion tunnel.

According to a less preferred embodiment the listening plates used for image current detection in a Fourier Transform mode of mass analysis may be situated at either end of the preferred ion guide or ion trap. An induced signal between the two listening plates may be measured differentially. The listening plates may be shaped such that the surface forming the inner boundary of the device closely follows the equi-potential lines of the radial potential produced by superposition of an axial quadratic potential along the length of the device. In this way there is minimal distortion of the axial quadratic potential in the proximity of the listening electrodes. For quadrupole or higher order multi-pole devices with circular or hyperbolic cross-section electrodes the radial equi-potential surface will be relatively complex. This situation may be greatly simplified by employing a multi-pole with circular concave electrodes forming a cylindrical geometry. Using this geometry the equi-potentials at the ends of the device form a hyperbolic surface. Listening plates may be designed to substantially follow these equi-potential lines.

Figure 9:
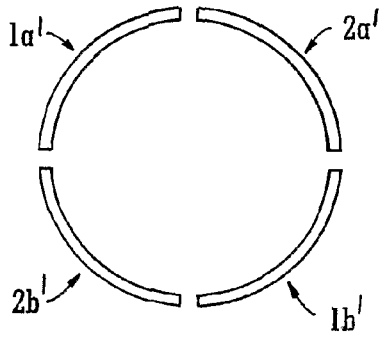
FIG. 9 shows a segmented quadrupole ion trap incorporating circular concave electrodes.

FIG. 9 shows a schematic of a quadrupole device incorporating circular concave electrodes in the x,y plane. The potential applied to electrode pair 1*a*', 1*b*' is given by:

$$\phi_1=\phi_0\cos(\Omega\cdot t)$$

The potential applied to electrode pair 2*a*', 2*b*' is given by:

$$\phi_2=-\phi_0\cos(\Omega\cdot t)$$

wherein $\phi_0$ is the 0-peak voltage of a radio frequency high voltage power supply, t is time in seconds and $\Omega$ is the angular frequency of the AC supply in radians/second.

Figure 10:
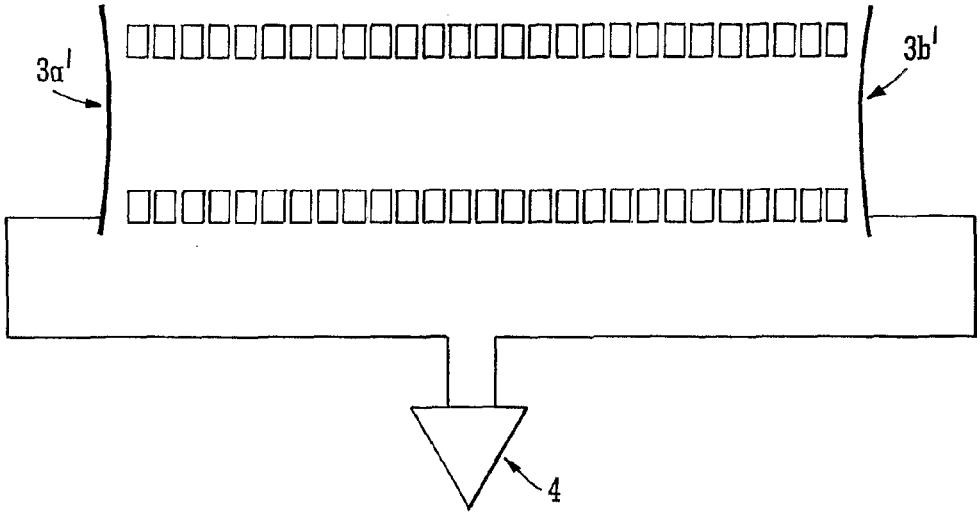
FIG. 10 shows a segmented cylindrical quadrupole ion guide or ion trap with hyperbolic shaped listening plates arranged at either end.

FIG. 10 shows a segmented cylindrical quadrupole ion guide or ion trap according to the preferred embodiment as modelled using SIMION® ion optics software. The cylindrical quadrupole ion guide or ion trap according to the preferred embodiment comprises concave circular electrodes and hyperbolic shaped listening plates 3*a*', 3*b*' following the radial equi-potentials at the ends of the ion guide or ion trap. The internal radius of the quadrupole for this particular embodiment was set at 5 mm and the overall length of the ion guide or ion trap was set at 29 mm. The listening plates 3*a*', 3*b*' are shown connected to a differential amplifier 4.

Other embodiments are contemplated wherein a monopole, hexapole, octapole or higher order multipole device may be utilised for radial confinement of ions instead of a quadrupole device. Higher order multipoles in particular have a higher order pseudo-potential well function. As a result the base of the pseudo-potential well is broader and therefore the ion guide or ion trap can have a higher capacity for charge. Advantageously, this enables the overall dynamic range to be improved. When the ion guide or ion trap is used in a resonance ejection mode then the higher order fields within non-quadrupolar devices will reduce the likelihood of radial resonance losses.

In non-linear radial fields the frequency of the radial secular motion is related to the radial position of the ions, therefore ions will go out of resonance before they are ejected. For all multipoles either hyperbolic or circular cross-section rods may be utilised.

In another embodiment the superimposed axial DC voltage may be non-linear such as hexapolar, octopolar or higher order or a more complex form. For example, during the ion introduction phase of analysis changing the axial voltage to a higher order form will improve the efficiency of initial ion trapping. Once ions have been thermalised by collision with cooling gas, the axial field may be restored to the ideal linear form for harmonic motion to be initiated.

According to an embodiment during resonance excitation for fragmentation in a MS-MS mode of operation the shape of the static superimposed DC field or time varying component of this field may be changed to reduce ion losses as excitation proceeds, improving collisionally induced dissociation efficiency.

In another less preferred embodiment the axial DC potential may be developed using continuous rods rather than segmented rods. In this case the rods may be non-conducting and may be coated with a non-uniform resistive material such that application of a voltage between the centre of the rods and the ends of the rods will result in an axial potential well being generated within the device.

In an embodiment the desired axial DC potential may be developed using a series of fixed or variable resistors between the individual segments of a RF multipole device.

In an embodiment the desired axial DC potential may be developed by placing a segmented, resistively coated, or suitably shaped electrode around the outside of a multipole device. Application of a suitable voltage to this can result in the required potential within the ion confinement region of the RF multipole.

In an embodiment a cylindrical segmented RF ion tunnel with a superimposed quadratic axial potential may be utilised. In this embodiment an RF voltage of alternating polarity is preferably applied to the adjacent annular rings of the ion tunnel. This provides confinement of ions in the radial direction. A superimposed quadratic axial potential allows ions to oscillate with simple harmonic motion in the centre of the tunnel. The frequency of this motion may be detected using image current detection and FFT techniques or alternatively ions may be axially resonantly ejected as previously described.

In addition to the embodiments described above further embodiments are contemplated involving multiple axial DC wells. By manipulating the superimposed DC applied to the electrode segments ions may be trapped in specific axial regions. Cooled ions may be moved to one end of the device to be released as the voltage reverts to a quadratic form. This mechanism may be used to initiate ion oscillations. Ions trapped within a DC potential well in a specific region of the device may be subjected to resonance ejection causing one or more ions to leave that potential well. Those ions ejected may be subsequently trapped in a separate potential well within the same device. This type of operation may be utilised to study ion-ion interactions. In this mode ions may be introduced from either or both ends of the device simultaneously.

Alternatively, ions trapped in a first potential well may be subjected to a resonance ejection condition which allows only a specific mass to charge ratio or mass to charge range to leave the first well and enter a second well. Resonance excitation may be performed in the second well to fragment these ions and the daughter ions sequentially resonantly ejected from this well for axial detection. Repeating this process MS/MS of all the ions within the first well may be recorded with 100% efficiency. It is possible to produce more than two potential wells within this device allowing complex experiments to be realised. Alternatively, this flexibility may be used to condition the characteristics of ion packets for introduction to other analysis techniques.

Although the present invention has been described with reference to preferred embodiments, it will be understood by those skilled in the art that various changes in form and detail may be made without departing from the scope of the invention as set forth in the accompanying claims.

The invention claimed is:

1. A mass spectrometer comprising:

an ion guide or ion trap comprising at least 10 axial segments, each axial segment comprising one or more electrodes, said ion guide or ion trap having a longitudinal axis;

means arranged and adapted to select parent or precursor ions within said ion guide or ion trap and to eject other ions from said ion guide or ion trap;

means arranged and adapted to fragment said selected parent or precursor ions within said ion guide or ion trap so as to generate fragment ions;

an oscillator configured to cause at least some of said fragment ions to oscillate in an axial direction along the longitudinal axis in a mode of operation so as to generate oscillating fragment ions; and a detector determining the frequency of oscillations of said oscillating fragment ions in said axial direction.

2. A mass spectrometer as claimed in claim 1, wherein said ion guide or ion trap comprises a multipole rod set ion guide or ion trap.

3. A mass spectrometer as claimed in claim 1, wherein said ion guide or ion trap comprises a plurality of non-conducting, insulating or ceramic rods, projections or devices.

4. A mass spectrometer as claimed in claim 3, wherein said plurality of non-conducting, insulating or ceramic rods, projections or devices further comprise one or more resistive or conducting coatings, layers, electrodes, films or surfaces.

5. A mass spectrometer as claimed in claim 1, wherein said ion guide or ion trap comprises a plurality of electrodes having apertures wherein ions are transmitted, in use, through said apertures.

6. A mass spectrometer as claimed in claim 1, further comprising an AC or RF voltage source applying an AC or RF voltage to at least some of said electrodes in order to confine ions radially within said ion guide or ion trap, the AC or RF voltage having an amplitude selected from the group consisting of (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

7. A mass spectrometer as claimed in claim 1, further comprising an AC or RF voltage source applying an AC or RF voltage to at least some of said electrodes in order to confine ions radially within said ion guide or ion trap, the AC or RF voltage having a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

8. Amass spectrometer as claimed in claim 1, wherein said oscillator comprises one or more DC or static voltage or potential supplies for supplying one or more DC or static voltages or potentials to said electrodes.

9. A mass spectrometer as claimed in claim 1, wherein said oscillator is arranged and adapted to maintain an approximately quadratic or substantially quadratic DC potential, along of least 10%, 20%, 30%, 40%, 50%, 60%, 70%, 80%, 90%, 95% or 100% of the axial length of said ion guide or ion trap.

10. A mass spectrometer as claimed in claim 9, wherein said quadratic DC potential comprises a potential well having a depth selected from the group consisting of: (i) <10 V; (ii) 10-20 V; (iii) 20-30 V; (iv) 30-40 V; (v) 40-50 V; (vi) 50-60 V; (vii) 60-70 V; (viii) 70-80 V; (ix) 80-90 V; (x) 90-100 V; and (xi) >100 V.

11. A mass spectrometer as claimed in claim 1, further comprising means arranged and adapted to maintain a substantially linear electrostatic field along at least 10%, 20%, 30%, 40%, 50%, 60%, 70%, 80%, 90%, 95% or 100% of the axial length of said ion guide or ion trap.

12. A mass spectrometer as claimed in claim 1, wherein said detector comprises one or more inductive or capacitive detectors.

13. A mass spectrometer as claimed in claim 12, wherein said one or more inductive or capacitive detectors are arranged substantially along substantially zero potential planes within said ion guide or ion trap or at the ion entrance to said ion guide or ion trap or at the ion exit to said ion guide or ion trap.

14. A mass spectrometer as claimed in claim 1, wherein said detector comprises an optical detector.

15. A mass spectrometer as claimed in claim 1, wherein said detector further comprises Fourier transform means for transforming time domain data or data relating to ion oscillations into frequency domain data or data relating to the frequency of ion oscillations.

16. A mass spectrometer as claimed in claim 15, wherein said detector further comprises means for determining the mass or mass to charge ratio of ions from said frequency domain data.

17. A mass spectrometer as claimed in claim 1, further comprising means arranged and adapted to maintain in a mode of operation said ion guide or ion trap at a pressure selected from the group consisting of: (i) $<1.0\times10^{-1}$ mbar; (ii) $<1.0\times10^{-2}$ mbar; (iii) $<1.0\times10^{-3}$ mbar; (iv) $<1.0\times10^{-4}$ mbar; (v) $<1.0\times10^{-5}$ mbar; (vi) $<1.0\times10^{-6}$ mbar; (vii) $<1.0\times10^{-7}$ mbar; (viii) $<1.0\times10^{-8}$ mbar; (ix) $<1.0\times10^{-9}$ mbar; (x) $<1.0\times10^{-10}$ mbar; (xi) $<1.0\times10^{-11}$ mbar; and (xii) $<1.0\times10^{-12}$ mbar.

18. A mass spectrometer as claimed in claim 1, further comprising means arranged and adapted to maintain in a mode of operation said ion guide or ion trap at a pressure selected from the group consisting of: (i) $>1.0\times10^{-3}$ mbar; (ii) $>1.0\times10^{-2}$ mbar; (iii) $>1.0\times10^{-1}$ mbar; (iv) >1 mbar; (v) >10 mbar; (vi) >100 mbar; (vii) $>5.0\times10^{-3}$ mbar; (viii) $>5.0\times10^{-2}$ mbar; (ix) $10^{-3}$–$10^{-2}$ mbar; and (x) $10^{-4}$–$10^{-1}$ mbar.

19. A mass spectrometer as claimed in claim 1, further comprising means arranged and adapted to collisionally cool or substantially thermalise ions within said ion guide or ion trap.

20. A mass spectrometer as claimed in claim 1, further comprising ejection means arranged and adapted to resonantly or mass selectively eject ions from said ion guide Or ion trap.

21. A mass spectrometer as claimed in claim 1, further comprising one or more ion detectors arranged upstream or downstream of said ion guide or ion trap.

22. A mass spectrometer as claimed in claim 1, further comprising a mass analyser.

23. A mass spectrometer as claimed in claim 1, wherein said oscillator is adapted to supply different DC voltages to different ones of said one or more electrodes in each axial segment so as to create a DC potential along said ion guide or ion trap that causes said ions to oscillate in said axial direction.

24. A masse spectrometer as claimed in claim 23, wherein said oscillator supplies a different DC voltage to each of said at least 10 axial segments so as to create a DC potential along said ion guide, or ion trap that causes said ions to oscillate in said axial direction.

25. A mass spectrometer as claimed in claim 1, wherein said oscillator is adapted to cause said fragment ions to undergo simple harmonic motion.

26. A method of mass spectrometry comprising:

providing an ion guide or ion trap comprising at least 10 axial segments, each axial segment comprising one or more electrodes, said ion guide or ion trap having a longitudinal axis;

selecting parent or precursor ions within said ion guide or ion trap and ejecting other ions from said ion guide or ion trap;

fragmenting said selected parent or precursor ions within said ion guide or ion trap so as to generate fragment ions;

causing at least some of said fragment ions to oscillate in an axial direction along the longitudinal axis in a mode of operation so as to generate oscillating fragment ions; and determining the frequency of oscillations of said oscillating fragment ions in said axial direction.

27. A method of mass spectrometry as claimed in claim 26, further comprising applying different DC voltages to different ones of said one or more electrodes in each axial segment so as to create a DC potential along said ion guide or ion trap that causes said ions to oscillate in said axial direction.

28. A method of mass spectrometry as claimed in claim 27, wherein a different DC voltage is applied to each of said at least 10 axial segments so as to create a DC potential along said ion guide or ion trap that causes said ions to oscillate in said axial direction.

29. A method of mass spectrometry as claimed in claim 26, further comprising causing said fragment ions to undergo simple harmonic motion.

30. A method of mass spectrometry as claimed in claim 26, further comprising applying an AC or RF voltage to at least some of said electrodes in order to confine at least some ions radially within said ion guide or ion trap.

31. A mass spectrometer comprising:

an ion guide or ion trap comprising at least 10 axial segments, each segment comprising one or more electrodes, said ion guide or ion trap having a longitudinal axis;

means arranged and adapted to select parent or precursor ions within said ion guide or ion trap and to eject other ions from said ion guide or ion trap;

means arranged and adapted to fragment said selected parent or precursor ions within said ion guide or ion trap so as to generate a plurality of fragment ions;

oscillation means arranged and adapted to, cause at least some of said fragment ions to oscillate and undergo simple harmonic motion in an axial direction along the longitudinal axis in a mode of operation; and detector means for determining the frequency of oscillations of said fragment ions in said axial direction.

32. A mass spectrometer as claimed in claim 31, wherein said oscillation means is adapted to supply different DC voltages to different ones of said one or more electrodes in each axial segment so as to create a DC potential along said ion guide or ion trap that causes said fragment ions to oscillate in said axial direction.

33. A mass spectrometer as claimed in claim 32, wherein said oscillation means supplies a different DC voltage to each of said at least 10 axial segments so as to create a DC potential along said ion guide or ion trap that causes said fragment ions to oscillate in said axial direction.

34. A method of mass spectrometry comprising:

providing an ion guide or ion trap comprising at least 10 axial segments, each segment comprising one or more electrodes, said ion guide or ion trap having a longitudinal axis;

selecting parent or precursor ions within said ion guide or ion trap and ejecting other ions from said ion guide or ion trap;

fragmenting said selected parent or precursor ions within said ion guide or ion trap so as to generate a plurality of fragment ions;

causing at least some of said fragment ions to oscillate and undergo simple harmonic motion in an axial direction along the longitudinal axis in a mode of operation; and determining the frequency of oscillations of said fragment ions in said axial direction.

35. A method of mass spectrometry as claimed in claim 34, further comprising applying different DC voltages to different ones of said one or more electrodes in each axial segment so as to create a DC potential along said ion guide or ion trap that causes said fragment ions to oscillate in said axial direction.

36. A method of mass spectrometry as claimed in claim 35, wherein a different DC voltage is applied to each of said at least 10 axial segments so as to create a DC potential along said ion guide or ion trap that causes said fragment ions to oscillate in said axial direction.

* * * * *